US005757402A

United States Patent [19]

Günther et al.

[11] Patent Number: 5,757,402

[45] Date of Patent: May 26, 1998

[54] MODULE ASSEMBLY FOR AN INK-JET PRINTER

[75] Inventors: Stephan Günther; Raimund Nisius, both of Berlin, Germany

[73] Assignee: Francotyp-Postalia AG & Co., Birkenwerder, Germany

[21] Appl. No.: 561,060

[22] Filed: Nov. 22, 1995

[30] Foreign Application Priority Data

Nov. 25, 1994 [DE] Germany ..... 44 43 245.3

[51] Int. Cl.[6] ..... B41J 2/14; B41J 2/045

[52] U.S. Cl. ..... 347/49; 347/68

[58] Field of Search ..... 347/49, 50, 68, 347/70, 71, 17

[56] References Cited

U.S. PATENT DOCUMENTS

| | | | |
|---|---|---|---|
| 3,988,745 | 10/1976 | Sultan | 347/47 |
| 4,599,628 | 7/1986 | Doring et al. | 346/140 |
| 4,695,854 | 9/1987 | Cruz-Uribe | 346/140 |
| 4,703,333 | 10/1987 | Hubbard | 346/140 |
| 5,148,194 | 9/1992 | Asai et al. | 346/140 |
| 5,446,484 | 8/1995 | Hoisington et al. | 347/68 |
| 5,592,203 | 1/1997 | Thiel et al. . | |

FOREIGN PATENT DOCUMENTS

| | | | |
|---|---|---|---|
| 0 486 256 | 5/1992 | European Pat. Off. . | |
| 0 615 844 | 9/1994 | European Pat. Off. . | |
| 38 05 279 | 8/1989 | Germany . | |
| 42 25 799 | 2/1994 | Germany . | |
| OS 42 30 292 | 3/1994 | Germany . | |
| 4-7156 | 1/1992 | Japan | 347/70 |
| 5-269995 | 10/1993 | Japan | 347/71 |
| 2 264 086 | 1/1993 | United Kingdom . | |
| WO 94/15791 | 7/1994 | WIPO . | |

OTHER PUBLICATIONS

Patents Abstract of Japan, M-56-Feb. 21, 1981, vol. 5, No. 29, Japanese application 54-62729.

*Primary Examiner*—David F. Yockey
*Assistant Examiner*—Judy Nguyen
*Attorney, Agent, or Firm*—Hill & Simpson

[57] ABSTRACT

In an ink-jet printer head having a number of edge-shooter module assemblies arranged in a stack, each module assembly has first and second circuit modules with an inkjet printer module therebetween. The ink-jet printer module is, in turn, formed by first and second cover plates with a middle plate therebetween. Piezoactuators are disposed on the cover plates in registry with ink pressure chambers in the module assembly, the ink pressure chambers respectively being in communication with nozzle apertures disposed at an edge of the module assembly. Various electrical components, including a driver circuit and conductor runs for operating the piezoactuators are disposed on the circuit modules in electrical contact with the piezoactuators.

9 Claims, 3 Drawing Sheets

MODULE ASSEMBLY FOR AN INK-JET PRINTER

BACKGROUND OF THE INVENTION

1. Field of the Invention

The present invention is directed to a module for an ink-jet printer head that is composed of a number of such modules in stacked fashion, the modules work according to the edge-shooter principle and being equipped with plate-shaped piezoelectric actuators for ejecting the ink.

2. Description of the Prior Art

Ink-jet printer heads of the above type are used in small, fast printers that are in turn a component part of modern machines for franking postal matter or for printing addresses. Such a printer is also suitable as a product labelling means.

Differing from standard office printers with line-by-line printing, printing in printers of the above-described type ensues as a one-time franking imprint in a single pass of the postal matter. Corresponding to this significantly greater printing width—approximately an inch—, the number of ink nozzles arranged under one another, and thus the number of piezoactuators is substantially larger in such an ink-jet printer head than in an ink-jet printer head for office printers.

Printer resolutions of approximately 200 dpi are required in order to satisfy modern requirements—imprints with word and image characters—for postage meter machines with good printing quality. This means ink-jet printer heads having the same number of nozzles and piezoactuators, given a printing width of one inch. Standard nozzle apertures lie between 40 through 50 μm in width. Given an imprint width of one inch and a resolution of 200 dpi, the adjustment errors must be kept below 10 μm.

Such ink-jet printer heads are necessarily implemented in planar or stacked fashion, first for reasons of permissible dimensions and the packing density that can thereby be achieved and, second, for reasons of economical manufacture (see German OS 42 25 799). Planar resonators are thereby usually utilized as the piezoactuators, whereby a piezoelectric material, for example lead-zirconate-titanate (PZT), is arranged between two metal electrodes. The carrier plate—which simultaneously serve as the diaphragm plate over the ink printer chambers—for the piezoactuators can be composed of glass, ceramic, plastic or metal.

The manner of arranging the modules relative to one another in order to achieve a printing density of 200 dpi in conjunction with the electrical contacting of the piezoactuators thereby an important problem to be satisfactorily resolved.

German OS 42 25 799 discloses an ink-jet printer head of the type initially described that is composed of a number of different modules of which only a module lying at the outside or only a module lying in the middle carries the common nozzle row at its edge. Each module is composed of a middle plate and diaphragm plates arranged at both sides thereof. The ink pressure chambers lie between the diaphragm plates and the middle plate. All modules have ink printer pressure chambers pressurizable by piezoactuators for ink ejection that are connected to the allocated nozzles via correspondingly conducted channels. The connecting channels from module to module necessarily proceed orthogonally relative to the pressure chambers.

Spacer parts that have an ink delivery aperture and ink passage apertures as well as a recess for the piezoactuators are arranged between the modules. The spacer parts can be of one piece or two pieces and are composed of the same material as the piezoactuators, which are arranged on the outside wall of the ink pressure chambers and are contacted to interconnects at that location.

Even though the advantage of only a single nozzle row is significant, the technological outlay for manufacturing modules which differ from one another is still considerable.

A higher precision as well as a more substantial adjustment are required for the connecting channels which proceed through a number of modules than are required for the ink pressure chambers. The connecting channels of different lengths require additional electronic control measures to equalize flow and pressure therein to ensure uniform ink droplets. When individual modules malfunction, the complicated assembly and adjustment precludes their replacement and, consequently, a replacement of the complete ink-jet printer head is required. Due to the large number of nozzles, these heads are significantly more expensive than ink-jet printer heads for standard office printers.

Further, German OS 38 05 279 discloses a piezoelectric ink-jet printer head having a monolithic piezoceramic body that has transducers arranged parallel next to one another, each transducer having a planar, piezoelectric drive element, a pressure chamber, an ink channel and a nozzle. The pressure chambers, the ink channels and the nozzles are fashioned as cavities in the piezoceramic body. Each drive element has an outer electrode, an inner electrode and an active piezoceramic layer arranged between the electrodes. The drive elements are piezoelectrically separated from one another by incisions in the active piezoceramic layer. The inner electrodes of the transducer are electrically connected to one another. The electrical connection of the outer and of the inner electrodes ensues via a connector band or a ribbon conductor. One connection proceeds to the inner electrodes connected to one another. The outer electrodes are separately contacted with terminals. The piezoceramic body has an underside and a side lying opposite the nozzle panel secured on a retainer frame. Ink connectors and the connector band are conducted through openings in the retainer frame. By obliquely orienting the retainer frame in a housing, the nozzle row is inclined relative to the moving direction of the recording medium, and consequently the printing density of the ink-jet printer head is enhanced (also see United Kingdom application 2 264 086, FIG. 3). A number of retainer frames or ink-jet printer heads can also be stacked on top of one another and be introduced in common into a housing. If one desired that the nozzle rows be staggered relative to one another in this known unit, either the retainer frames would have to be differently adapted or the housing would have to have appropriate steps. The housing has an ink connector and electrical terminals. Although this ink-jet printer head achieves high resolution, the technological outlay—including the adjustment outlay—is substantial.

Lastly, U.S. Pat. No. 4,703,333 discloses an ink-jet printer head wherein a number of ink printer modules that operate according to the side-shooter principle are stacked inclined following one another such that the nozzle region and the ink supply region are free. A receptacle frame having slanting steps is matched to this fishscale-like arrangement. In order to achieve the lateral offset of the nozzles relative to one another, the ink printer modules are provided with oblong holes through which screws that engage into threaded holes of the steps are conducted. The modules must be adjusted with a template and then be locked with the screws. The individual ink printer module is composed of a nozzle plate, of an ink channel plate, a pressure chamber plate, a diaphragm plate with piezoactuators and a cover plate with a recess for a ribbon conductor for contacting the piezoactuators. An ink delivery channel with two ink connection sockets is machined or molded into the cover plate.

A replacement of individual ink printer modules is in fact possible, but only by unsoldering the ribbon conductor, and the number of discrete parts and the adjustment outlay are considerable. A cleaning and sealing station adapted to this ink-jet printer head will have a very complicated structure because of the stepping.

SUMMARY OF THE INVENTION

In general, it is an object of the present invention to simplify the ink-jet printer head structure and improve the servicing capability thereof.

More specifically, it is an object of the present invention to provide a module assembly, for an ink-jet printer head composed of a plurality of such identical module assemblies, that is constructed as an independent functional unit and, consequently, can be easily replaced. It is a further object to minimize reject rates in the manufacture of this module assembly.

The above object is achieved in accordance with the principles of the present invention in an edge-shooter module for an ink-jet printer head of the type composed of a number of identical such modules arranged in a stack, the module being formed by two circuit modules with an ink-jet printer module disposed therebetween. The inkjet printer module is composed of a first cover plate, a middle plate, and a second cover plate, with piezoactuators being arranged on the cover plates disposed in registry with ink pressure chambers in a cover plate or in the middle plate. The cover plates are arranged mirror symmetrically adjacent opposite sides of the middle plate, and each circuit module is formed by a carrier on which electrical conductor runs are disposed which terminate in contact elements for making electrical contact with the piezoactuators. These conductor runs lead to a drive circuit also disposed on the carrier layer which is, in turn, connected to a plug-type module also disposed on the carrier layer. A temperature sensor and heating resistors may also be disposed on the carrier layer, and if so these components will also be electrically connected by conductor runs to the driver circuit.

A number of advantages are achieved by the inventive module.

The division of the module assembly into three submodules—of which two (the two circuit modules) can still be identical—enables an individual testing of each submodule as well as a testing of the overall module assembly using appropriate adapters. Possible faults can thereby be quickly localized and identified. Given faults, usually only one assembly has to be replaced; this leads to considerable savings during manufacture and in the case of repairs.

Although the degree of integration is noticeably enhanced compared to known devices and the individual module continues to be expensive because of the large number of nozzles, an increase in the yield and better and more economical service are nonetheless achieved.

The individual circuit module can be advantageously produced on ceramic in hybrid circuit technology. Interconnects and resistors as well as capacitors and sensors can be realized by applying the various layer and thick-film pastes. The good thermal conductivity of the ceramic substrate enables good heat transmission to the ink-jet printer module; in particular, it is also possible to arrange the heating resistors (for preventing the ink from becoming too viscous) on that surface of the circuit module facing toward the ink-jet printer module. Thus, the dissipated heat produced in the driver circuits can be used at the same time for heating the ink-jet printer head or for heating the ink-jet printer module, as a result of which the dissipated heat of the overall ink-jet printer head is significantly reduced.

The assembly and contacting of the piezoactuators is simplified as a result of the one-piece, comb-like embodiment and the arrangement of all electrodes in one plane. The contacting can ensue with a solder having a low melting point, such as indium, or by bonding. When a number of modules are combined to form an inkjet printer head, the circuit modules can function as spacer and adjustment members at the same time. Two neighboring ink-jet printer modules can share a circuit module in common. This makes a substantial savings possible.

DESCRIPTION OF THE PREFERRED EMBODIMENTS

Figure 1:
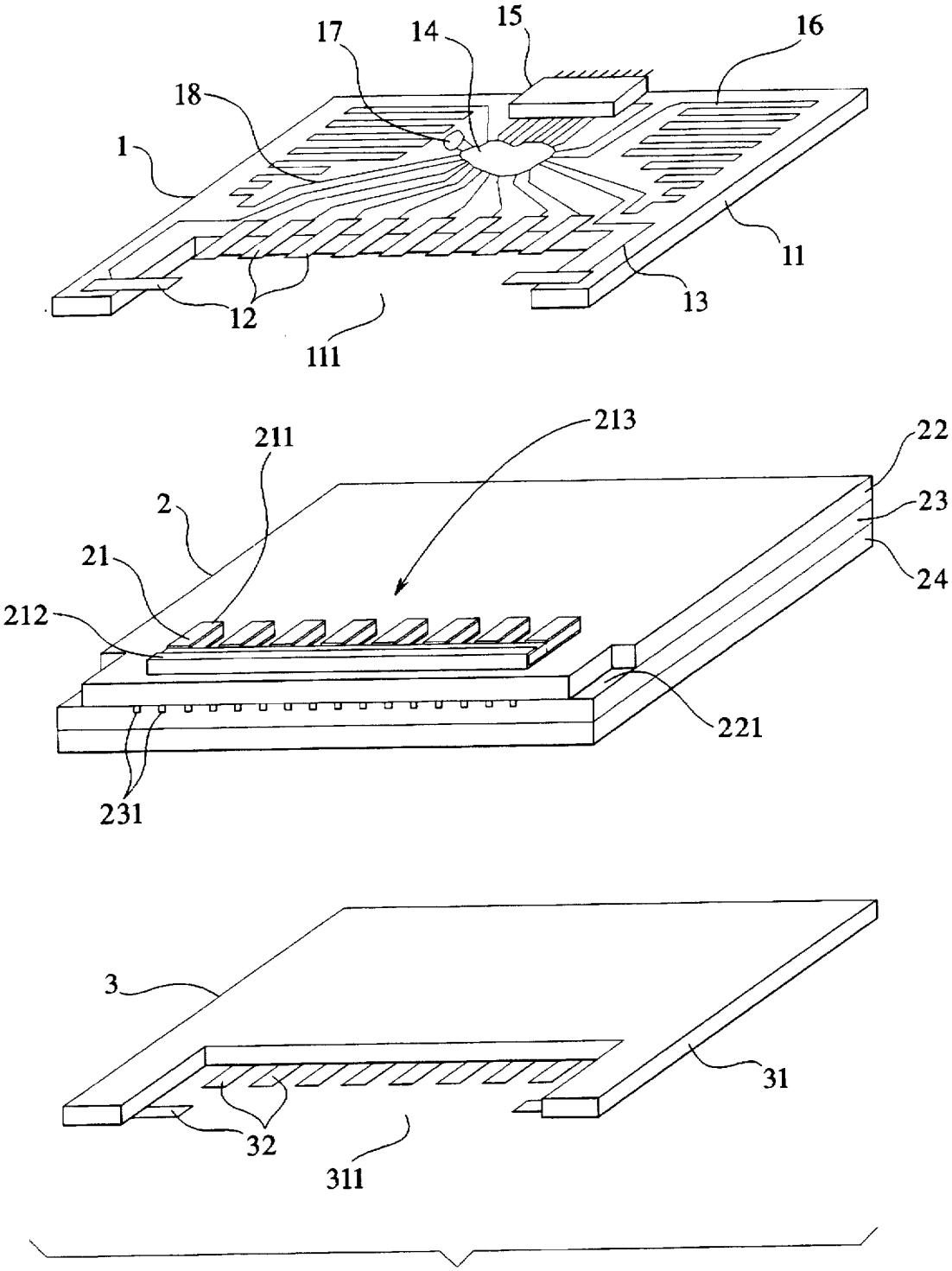
FIG. 1 is an explored view of an ink-jet print module construted in accordance with the principles of the present invention.

The illustrations in the figures are schematic in order to facilitate a better understanding.

The inventive module is composed of two identical circuit modules 1 and 3 and an ink-jet printer module 2 arranged between them.

The circuit module 1 is a plate-shaped carrier 11 on which interconnects 13 with contact elements 12 in the form of contact lugs, heating resistors 16 for heating the head, a sensor 17 for temperature measurement and monitoring, a driver circuit 14 and a plug-type connector 15 are arranged. The driver circuit 14 is connected to conductor runs 18 which repectively terminate in contact elements 12 which serve the purpose of respectively electrically contacting a plurality of piezoactuators 21. In the assembled condition, the piezoactuators 21 project into the recess 111 of the carrier 11. The piezoactuators 21 can be formed by an overall piezoactuator assembly 213. The driver circuit 14 contains the driver sub-circuits for individually operating (exciting) the drive of the piezoactuators 21.

The ink-jet printer module 2 is composed of a first cover plate 22, a middle plate 23 and a second cover plate 24.

The piezoactuators 21 are arranged on the first cover plate 22 in regions under which ink pressure chambers are formed in the cover plate 22. One such pressure chamber 26 is shown in the side view of FIG. 3. Identical chambers are respectively disposed beneath each piezoactuator 21. The cover plate 22 is provided with recesses 221 that extend to the middle plate 23 and serve the purpose of subsequent, positionally exact fastening of the module in an ink-jet printer housing.

Nozzle apertures 231 and nozzle channels associated (one nozzle channel 27 being visible in the side view of FIG. 3) are formed in the middle plate 23 in that surface thereof facing toward the first cover plate 22. All nozzle apertures 231 lie in one plane. Alternatively, these nozzle apertures 231 and channels 27 can be formed in one of the cover plates.

Figure 3:
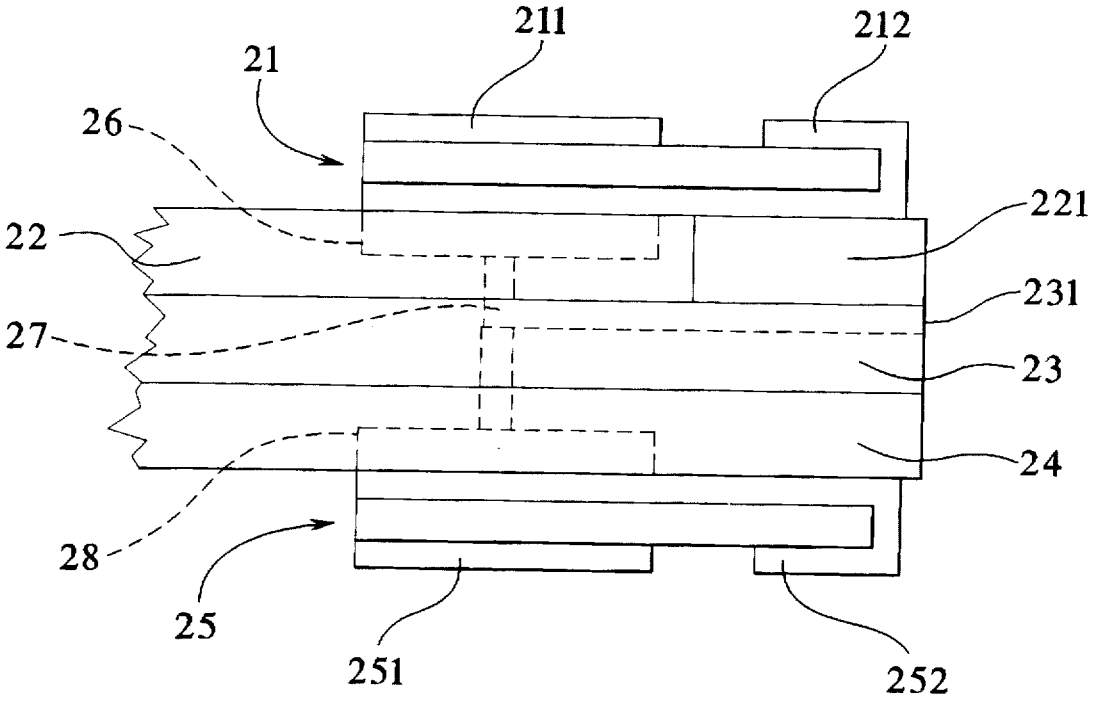
FIG. 3 is a sectional view through the middle three plates in the ink-jet printer module of FIGS. 1 and 2.

Piezoactuators 25 are arranged—on the second cover plate 24, likewise in regions under which ink pressure chambers are formed in the cover plate 24, as also shown in FIG. 3. The chambers 28 respectively communicate with channels 27, such as in alternation with the chambers 26. In the side view of FIG. 3, only one channel 27 can be seen, and this is in communication with only one chamber, such as chamber 26. The next nozzle channel 27 (and all other nozzles channels 27) to which the chamber 28 (and further chambers 26 and 28) is/are connected, are behind the channel 27 which is depicted in FIG. 3.

The circuit module 3 is identically constructed compared to the circuit module 1 and is merely arranged rotated by 180° over relative to the ink-jet printer module 2.

Correspondingly, the circuit module 3 is composed of a plate-shaped carrier 31, on which interconnects with contact elements 32, heating resistors 36, a temperature sensor 37, a driver circuit 34 and a plug-type connector 35 are arranged. These other components are disposed on the carrier 31 in a manner identical to the corresponding components disposed on the carrier 11 of the circuit module 1, so that when the circuit modules 1 and 3 are disposed on the ink-jet printer module 2, the components on the respective circuit modules 1 and 3 will be arranged mirror symmetrically.

Figure 2:
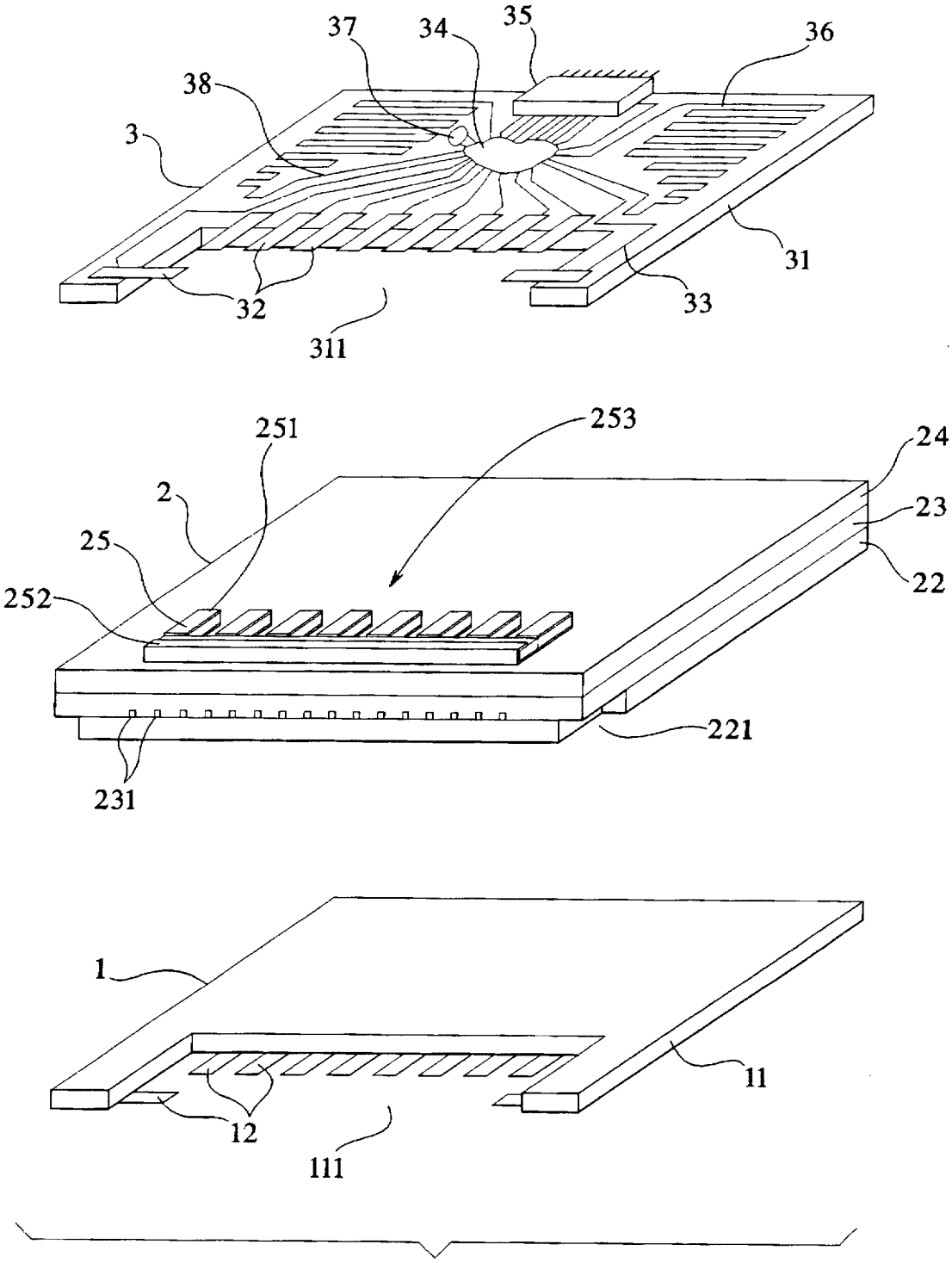
FIG. 2 is an exploded view of the ink-jet printer module in FIG. 1, reversed by 180°.
Figure 4:
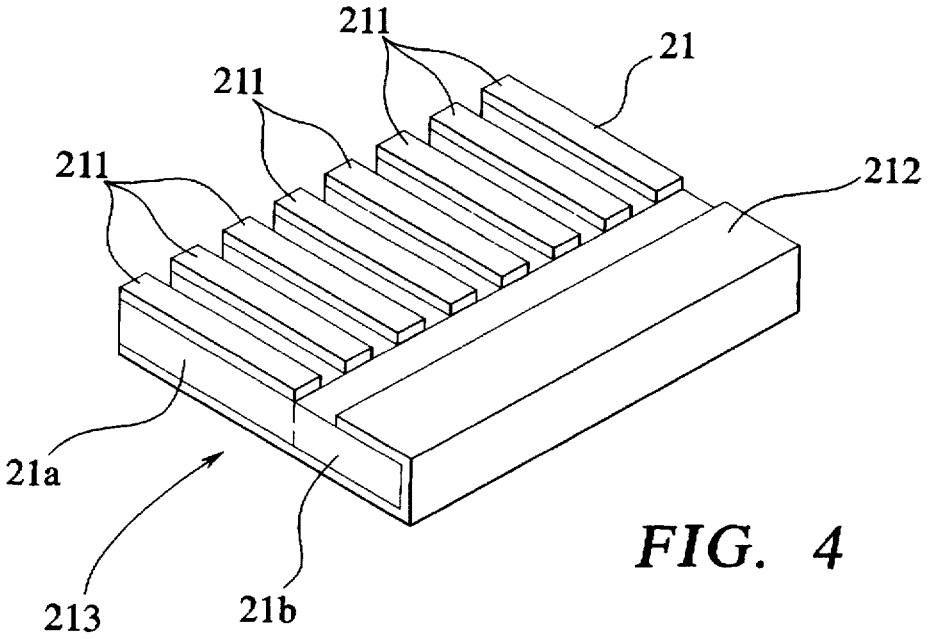
FIG. 4 is a perspective view of the piezoactuators used on each of the circuit modules in the ink-jet printer module of the invention.

The driver circuit 34 is connected to conductor runs 38 which respectively terminate in contact elements 32 which are electrically contacted with the piezoactuators 25. The recess 311 in the carrier plate 31 is provided for the piezoactuators 25. When the piezoactuators 21 and 25 are formed in piezoactuator assemblies 213 and 253, each of the piezoactuators 21 and 25 has an active region 21*a* as well as an inactive region 21*b*, as shown for the piezoacutators 21 in FIG. 4. The piezoactuator assembly 213 shown in FIG. 4 has a common electrode 212 and spatially separated electrodes 211, which define the individual piezoactuators 21. The piezoactuator assembly 253 (FIG. 2) is identically constructed and also has active and inactive regions and a common electrode 252 and spatially separated electrodes 251, which define the individual piezoactuators 25.

Although modifications and changes may be suggested by those skilled in the art, it is the intention of the inventors to embody within the patent warranted hereon all changes and modifications as reasonably and properly come within the scope of their contribution to the art.

We claim as our invention:

1. An edge-shooter module assembly for an ink-jet printer head, said module assembly comprising:

a first circuit module and a second circuit module;

an ink-jet printer module disposed between and adjacent said first circuit module and said second circuit module, said module assembly comprising no other modules;

said ink-jet printer module comprising a first cover plate adjacent said first circuit module containing a plurality of first ink pressure chambers, a second cover plate adjacent said second circuit module containing a plurality of second ink pressure chambers, and a middle plate between said first cover plate and said second cover plate containing a first plurality of nozzle channels respectively in fluid communication with said first ink pressure chambers and a second plurality of nozzle channels respectively in fluid communication with said second ink pressure chambers, each of said nozzle channels terminating at a nozzle with the nozzles of the respective nozzle channels being disposed in a single, planar nozzle row at an edge of said middle plate;

a plurality of first piezoactuators disposed on said first cover plate in registry with said first ink pressure chambers and a plurality of second piezoactuators disposed on said second cover plate in registry with said second ink pressure chambers;

said first circuit module comprising a first carrier having a plurality of first conductor runs thereon respectively in electrical contact with said first piezoactuators, first driver circuit means disposed on said first carrier, connected to said first conductor runs, for driving said first piezoactuators, and a first plug connector disposed on said first carrier electrically connected to said first driver circuit means; and said second circuit module comprising a second carrier having a plurality of second conductor runs thereon respectively in contact with said second piezoactuators, second driver circuit means disposed on said second carrier, connected to said second conductor runs, for driving said second piezoactuators, and a second plug connector disposed on said second carrier electrically connected to said second driver circuit means.

2. A module assembly as claimed in claim 1 wherein said first circuit module further comprises a first temperature sensor disposed on said first carrier and electrically connected to said first driver circuit means, and wherein said second circuit module comprises a second temperature sensor disposed on said second carrier and electrically connected to said second driver circuit means.

3. A module assembly as claimed in claim 1 wherein said first circuit module further comprises a first heating resistor disposed on said first carrier and electrically connected to said first driver circuit means and wherein said second circuit module further comprises a second heating resistor disposed on said second carrier and electrically connected to said second driver circuit means.

4. A module assembly as claimed in claim 1 wherein one of said first cover plate and said second cover plate has recesses therein extending to said middle plate in a region neighboring said nozzle row for positioning said module assembly.

5. A module assembly as claimed in claim 1 wherein said first circuit module has a recess therein for receiving said first piezoactuators and wherein said second circuit module has a recess therein for receiving said second piezoactuators.

6. A module assembly as claimed in claim 1 wherein said first circuit module and second circuit module are identical.

7. A module assembly as claimed in claim 1 wherein each of said first carrier and said second carrier is plate-shaped.

8. A module assembly as claimed in claim 1 wherein said first piezoactuators are combined in a piezoactuator assembly having a piezoelectric element having a common region from which a plurality of finger regions extend, said piezoelectric element having a first side and a second opposite side with an edge therebetween, and a plurality of first electrodes respectively disposed over said fingers on said first side and a second electrode disposed on said second side and continuing over said edge and onto a portion of said first side and terminating on said first side spaced from said first electrodes, said second electrode forming a common electrode for all of said first piezoactuators, and said piezoelectric element having active regions respectively disposed between said first electrode and second electrode and a remainder comprising an inactive region.

9. An edge-shooter module assembly for an ink-jet printer head, said module assembly comprising:

identical first and second circuit modules;

an ink-jet printer module disposed between and adjacent said first and second circuit modules, said module assembly comprising no other modules; and said ink-jet printer module having a plurality of ink pressure chambers therein respectively in fluid communication with a plurality of nozzle channels in said ink-jet printer module, said nozzle channels each terminating in a nozzle aperture with the respective nozzle apertures of the nozzle channels being disposed in a single, planar row at an edge of said ink-jet printer module, said ink-jet printer module further having a first set of electrically actuated ink ejectors respectively in registry with ink pressure chambers of a first sub-plurality of said plurality said ink pressure chambers and a second set of electrically actuated ink ejectors respectively in registry with ink ejectors of a second sub-plurality of said plurality of ink pressure chambers, and said first circuit module carrying a first drive means, and said second circuit module carrying a second drive means, said first drive means and said second drive means being respectively electrically connected to said first sat and second set of electrically actuated ink ejectors for respectively actuating said first set and said second set of electrically actuated ink ejectors to force ink respectively from said plurality of ink pressure chambers through said nozzle channels and out of said nozzle apertures, said first circuit module having a recess therein for receiving all of said first set of electrically actuated ink ejectors and said second circuit module having a recess therein for receiving all of said second set of electrical actuated ink ejectors.

* * * * *